US006969208B2

(12) United States Patent
Shinya

(10) Patent No.: US 6,969,208 B2
(45) Date of Patent: Nov. 29, 2005

(54) SLIDER FOR A SOLID PASTE DISPENSER

(75) Inventor: Masashi Shinya, Kasukabe (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

(21) Appl. No.: 10/428,124

(22) Filed: May 2, 2003

(65) Prior Publication Data

US 2003/0206764 A1 Nov. 6, 2003

(30) Foreign Application Priority Data

May 2, 2002 (JP) ..... 2002-130924

(51) Int. Cl.[7] ..... A45D 40/02; B43K 21/08
(52) U.S. Cl. ..... 401/87; 401/88; 401/75
(58) Field of Search ..... 401/75, 68, 86, 401/87, 88, 175

(56) References Cited

U.S. PATENT DOCUMENTS 3,219,044 A * 11/1965 Bau ..... 401/75
3,612,705 A * 10/1971 Duval ..... 401/75

FOREIGN PATENT DOCUMENTS

DE 3118893 A1 11/1982
JP 2000335193 A 12/2000

* cited by examiner

*Primary Examiner*—David J. Walczak
(74) *Attorney, Agent, or Firm*—Sughrue Mion, PLLC

(57) ABSTRACT

A slider for a solid paste dispenser has a planar base portion and a tubular portion projecting from the center of the base portion into a solid paste. A screw rod extends through the base and tubular portions and is engaged therewith in threaded manner, and the tubular portion has as an integral part thereof a radially outwardly extending protrusion or a number of such protrusions so formed as to satisfy the equation $S_0-S_M \geqq S_1+S_2+ \ldots +S_n$ where $S_0$ stands for the area ($cm^2$) of the upper surface of the base portion, $S_1$ to $S_n$ each stand for the area ($cm^2$) of the lower surface of one of the n protrusions, and $S_M$ stands for a maximum area ($cm^2$) of $S_1$ to $S_n$ in which each of $S_0$ and $S_1$ to $S_n$ excludes the area occupied by the tubular portion.

28 Claims, 6 Drawing Sheets

SLIDER FOR A SOLID PASTE DISPENSER

FIELD AND BACKGROUND OF THE INVENTION

This invention relates to a slider for a solid paste dispenser.

Solid paste dispensers are described in, for example, Japanese Patent Application No. 59080/1999, Japanese Patent Publication No. 5502/1996 and Japanese Utility Model Registration No. 2,534,943. A typical device is shown in FIG. 8. A tail plug 02 is rotatably fitted in the rear end of a cylindrical casing 01 to cause a screw rod 03 forming an integral part of the plug 02 to rotate in the casing 01 and a slider 05 is threadedly engaged with the screw rod 03 and is longitudinally movable along the screw rod 03 and guide ridges 04 formed on the inner wall surface of the casing 01 and extending axially thereof. A stick of a solid paste 06 has its rear end held by the slider 05 so that its front end may protrude out of the casing 01 or retract thereinto with the movement of the slider 05. The slider 05 is cylindrical and has a bottom formed with a threaded hole through which the screw rod 03 extends. The device has a cap 07.

The slider 05, however, gives the device the following drawbacks: (a) The solid paste 06 having its rear end simply fitted in the slider 05 is likely to come out from the slider 05 easily if its front end sticks to a surface to be coated with the paste, and is thereby pulled; and (b) The rear end portion of the solid paste 06 which is fitted in the slider 05 usually occupies as much as about 15% of its entire length, and is wasted without being used effectively as a paste.

OBJECTS OF THE INVENTION

It is an object of the present invention to provide an improved slider for use in a solid paste dispenser, which can hold a solid paste firmly in position and prevent it from breaking or coming out therefrom or from the dispenser. It is another object of the present invention to provide a slider for use in a solid paste dispenser which permits a more effective use thereof for sticking purposes. It is still another object of the present invention to provide a slider for a solid paste dispenser by which any waste of the paste can be reduced.

SUMMARY OF THE INVENTION

These and other objects are attained in accordance with one aspect of the present invention by a slider for holding a stick of a solid paste in a solid paste dispenser and threadedly engaged with a screw rod forming an integral part of a tail plug fitted in one end of a cylindrical casing rotatably for rotating the screw rod in the casing to move the slider longitudinally in the casing along guide ridges formed on the inner wall surface of the casing and extending axially thereof so that the paste may be protruded out of the casing at its distal end or retract thereinto, wherein a planar base portion and a tubular portion projecting from the center of the base portion into the paste, the screw rod extending through the base and tubular portions and being threadedly engaged therewith, the tubular portion having as an integral part thereof a radially outwardly extending protrusion or a number of such protrusions satisfying equation 1:

$$S_0-S_M \geqq S1+S2+\ldots+S_n \quad (1)$$

where $S_0$ stands for the area ($cm^2$) of the upper surface of the base portion;

$S_1$ to $S_n$ each stand for the area ($cm^2$) of the lower surface of one of the number (n) of protrusions;

$S_M$ stands for the maximum area ($cm^2$) of $S_1$ to $S_n$;

each of $S_0$ and $S_1$ to $S_n$ excludes the area occupied by the tubular portion.

The solid paste held by the slider according to the invention has its outer peripheral surface exposed even at its rear end and can, therefore, be used very effectively for sticking purposes with only a small part thereof wasted. The slider also makes it possible to prevent the paste from breaking near its rear end and falling out of the dispenser.

According to a preferred embodiment of the invention the protrusions further satisfy equation 2:

$$CaP(S_1h_1+S_2h_2+\ldots+S_nh_n)/\{(h_1+h_2+\ldots+h_n)+(d_1+d_2+\ldots+d_n)\}=Na\geqq 20 \quad (2)$$

where $S_1$ to $S_n$ each stand for the area ($cm^2$) of the lower surface of one of the number (n) of protrusions;

$S_1$ to $S_n$ each stand for the area ($cm^2$) of the lower surface of one of the number (n) of protrusions;

$S_M$ stands for a maximum area ($cm^2$) of $S_1$ to $S_n$;

where $h_1$ to $h_n$ each stand for the distance (cm) between the base portion and the protrusion facing it and adjacent protrusions;

$d_1$ to $d_n$ each stands for the thickness (cm) of each protrusion,

P stands for the hardness ($N/cm^3$) of the paste,

Ca is a constant;

Na stands for the falling force (N) of the paste.

The slider can effectively prevent the paste from falling out by breaking at its rear end portion fitted between every two adjoining protrusions or between the base portion and the protrusion facing it even if the paste may firmly stick to a surface to which it has been applied, or when the paste is retracted into the casing after use.

According to another embodiment of the invention $Ca=11.06\times10^5$. This relationship ensures that the slider be still easier to design and manufacture.

According to another embodiment of the invention the thickness of all the protrusions are practically negligibly small in that the thickness is less than about one-fifth of the distance between adjoining protrusions. This relationship ensures that the advantages as stated above be still easier to obtain.

According to another embodiment of the invention $Ca=9.49\times10^5$. This relationship ensures that the slider as set forth above be still easier to design and manufacture.

According to another aspect of the invention in a slider for holding a stick of a solid paste in a solid paste dispenser and threadedly engaged with a screw rod forming an integral part of a tail plug fitted in one end of a cylindrical casing rotatably for rotating the screw rod in the casing to move the slider longitudinally in the casing along guide ridges formed on the inner wall surface of the casing and extending axially thereof so that the paste may protrude out of the casing at its distal end or retract thereinto, the improvement which comprises a planar base portion and a tubular portion projecting from the center of the base portion into the paste, the screw rod extending through the base and tubular portions and being threadedly engaged therewith, the tubular portion having as an integral part thereof a radially outwardly extending protrusion or a number protrusions satisfying equations 3 and 4:

$$S_0-S_M<S_1+S_2+\ldots+S_n \quad (3)$$

$$CbP(S_0-S_M)=Nb\geqq 20 \quad (4)$$

where $S_0$ stands for the area ($cm^2$) of the upper surface of the base portion;

$S_1$ to $S_n$ each stand for the area ($cm^2$) of the lower surface of one of the n protrusions;

SM stands for the maximum area ($cm^2$) of $S_1$ to $S_n$;

each of $S_0$ and $S_1$ to $S_n$ excludes the area occupied by the tubular portion;

P stands for the hardness ($N/cm^2$) of the paste;

Cb is a constant;

Nb stands for the falling force (N) of the paste.

According to a preferred embodiment of the invention $Cb=5.50\times10^{3}$. This relationship ensures that the slider as set forth above be still easier to design and manufacture.

According to another embodiment of the invention the protrusions are of the same shape. In particular the protrusions may be circular or polygonal. This arrangement ensures that the slider exhibiting the advantages as stated above be still easier to obtain.

Still according to another embodiment of the invention all the protrusions have the same area in their lower surfaces ($S_1$ to Sn are equal). The slider is simpler in construction and easier to manufacture.

Finally according to another embodiment of the invention the protrusions are circular, lie one above another along the tubular portion and have a smaller diameter as they are remoter from the base portion. The slider ensures the effective use of the paste along the outer peripheral surface of its rear end portion for sticking purposes.

BRIEF DESCRIPTION OF THE DRAWINGS

The invention will now be explained in more detail hereinafter with reference to the drawings and embodiments thereof. In the drawings.

DETAILED DESCRIPTION OF PREFERRED EMBODIMENTS OF THE INVENTION

Figure 1:
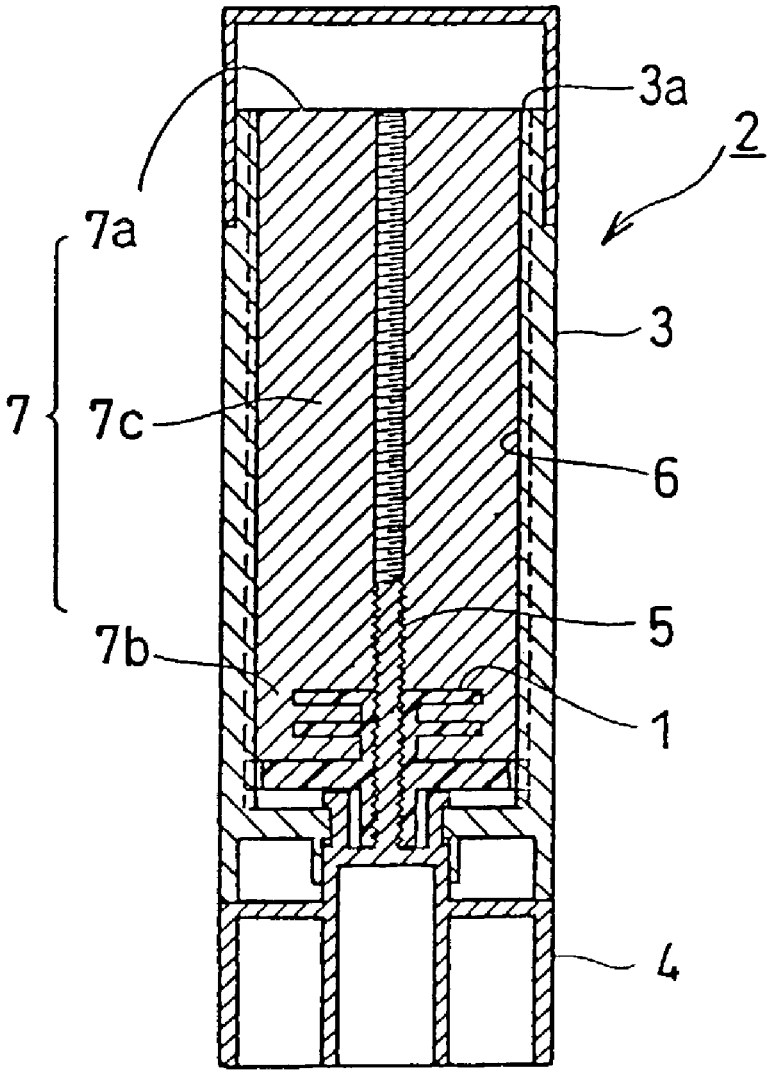
FIG. 1 is a longitudinal sectional view of a solid paste dispenser including a slider according to an embodiment of the invention.

Referring first to FIG. 1, a solid paste dispenser 2 having a slider 1 embodying the present invention has a cylindrical casing 3 having a pair of axially extending guide ridges 6 formed on its inner wall surface, a tail plug 4 fitted rotatably in the rear end of the casing 3, a screw rod 5 forming an integral part of the plug 4 and engaged threadedly with the slider 1 in the casing 3, and a stick of a solid paste 7 held on the slider 1. If the plug 4 is rotated, the screw rod 5 is rotated to move the slider 1 longitudinally along the guide ridges 6 to thereby cause the paste 7 to protrude out of the casing 3 at its front end 7*a* or retract thereinto.

Figure 2:
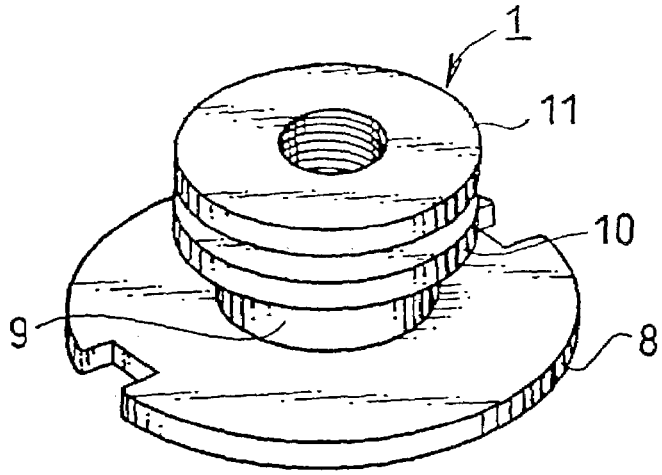
FIG. 2 is a perspective view of the slider shown in FIG. 1.
Figure 3:
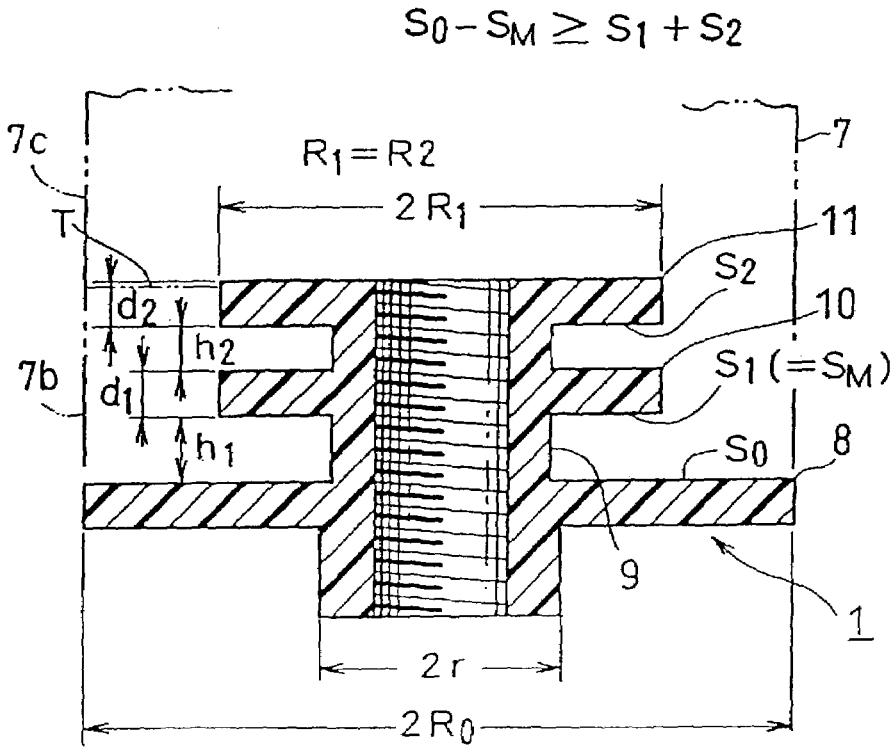
FIG. 3 is a longitudinal sectional view of the slider shown in FIG. 2.

Referring to FIGS. 1 to 3, the slider 1 has a planar base portion 8 and a cylindrical portion 9 projecting from the center of the base portion 8 into the paste 7. The screw rod 5 extends through the base and cylindrical portions 8 and 9 and is threadedly engaged therewith. The cylindrical portion 9 has a pair of radially outwardly extending protrusions 10 and 11 forming integral parts to hold the paste 7. The protrusions 10 and 11 extend in the center of the rear end 7*b* of the paste 7 at right angles to its longitudinal axis, so that the paste 7 may not fall off the slider 1 even if it may be drawn forward.

It is, however, not sufficient to hold the paste 7 so that it may not fall off the slider 1, but it is also necessary to prevent the paste 7 from falling off the casing 3. It is, for example, likely that the paste 7 may be torn off in its portion T surrounding the upper protrusion 11 (FIG. 3) and fall off the casing 3 in its upper (or front) portion 7*c* before its rear end 7*b* falls off the slider 1, depending on, for example, the diameters of the protrusions 10 and 11. Such tearing is likely to occur to that portion of the paste 7 which surrounds the protrusion having the largest lower surface area if there are a plurality of differently sized protrusions.

In this connection, it has been found as a result of research work that the protrusions 10 and 11 so formed as to satisfy equation (1) below make it possible to prevent the paste 7 from being torn off near its rear end 7*b* and from falling off the casing 3 before falling off the slider 1:

$$S_0-S_M \geqq S_1+S_2+\ldots+S_n \tag{1}$$

where $S_0$ stands for the area ($cm^2$) of the upper surface of the base portion 8;

$S_1$ to $S_n$ each stand for the area ($cm^2$) of the lower surface of one of the number (n) of protrusions 10 and 11;

$S_M$ stands for the maximum area ($cm^2$) of $S_1$ to $S_n$;

each of $S_0$ and $S_1$ to $S_n$ excludes the area occupied by the cylindrical portion 9.

The protrusions 10 and 11 so formed as to satisfy equation (1) can effectively prevent the paste from being torn off as stated above, even if they may be of any shape, such as oval or polygonal, instead of circular as shown in FIGS. 2 and 3.

It is, however, not yet sufficient to prevent the paste 7 from being torn off. As a result of a study of the main, usually possible, causes for the paste 7 falling off the casing 3, the following has been found:

(a) it is likely that if the paste 7 has its front end 7*a* pressed strongly against e.g. a paper surface during its application, its front end 7*a* may be enlarged in diameter and caught by the front edge 3*a* of the casing 3 when it has to be retracted into the casing 3, and that if the plug 4 is rotated to move back the slider 1 in the casing 3, the paste 7 may fall off the slider 1, or be torn off;

(b) it is also likely that if the paste 7 has its front end 7*a* pressed strongly against e.g. a paper surface during its application, its front end 7*a* may adhere to the paper surface so firmly that the paste 7 may fall off the casing 3, or be torn off when its front end 7*a* is moved away from the paper surface; and (c) it is also likely that the repeated protrusion and retraction of the paste 7 relative to the casing 3 may eventually result in the paste 7 falling off the slider 1, or being torn off, as there is a certain amount of frictional resistance between the inner wall surface of the casing 3 and the outer peripheral surface of the paste 7.

In order to prevent the paste 7 from falling off under such circumstances, it has been found that it is effective to have the paste 7 held by the slider 1 with a holding force of at least 20 N (Newton), while also preventing it from being torn off. As a result of continued research work, it has been found effective to form the protrusions 10 and 11 so that they may satisfy equation (2) below:

$$CaP(S_1h_1+S_2h_2+\ldots+S_nh_n)/\{(h_1+h_2+\ldots+h_n)+(d_1+d_2+\ldots+d_n)\}=Na\geqq20 \tag{2}$$

$S_1$ to $S_n$ each stand for the area ($cm^2$) of the lower surface of one of the number (n) of protrusions;

each $S_1$ to $S_n$ excludes the area occupied by the cylindrical portion;

$h_1$ to $h_n$ each stand for the distance (cm) between the base portion and the protrusion facing it, or between every adjoining two of the number (n) of protrusions;

$d_1$ to $d_n$ each stand for the thickness (cm) of one of the protrusions;

P stands for the hardness ($N/cm^3$) of the paste;

Ca is a constant;

Na stands for the falling force (N) of the paste.

Ca is usually $11.06\times10^5$, though it may somewhat depend on the frictional resistance existing between the inner wall surface of the casing 3 and the outer peripheral surface of the paste 7, the length of the casing 3, etc.

It is possible to regard the total of $d_1$ to $d_n$ as zero in equation (2) if the thickness of all the protrusions 10 and 11 are practically negligibly small. The thickness of the protrusions 10 and 11 are practically negligible if they are less than about one-fifth of the distance between the adjoining protrusions 10 and 11. If the total of $d_1$ to $d_n$ is regarded as zero, Ca is usually taken as $9.49\times10^5$, though it may somewhat depend on the frictional resistance existing between the inner wall surface of the casing 3 and the outer peripheral surface of the paste 7, etc.

Figure 4:
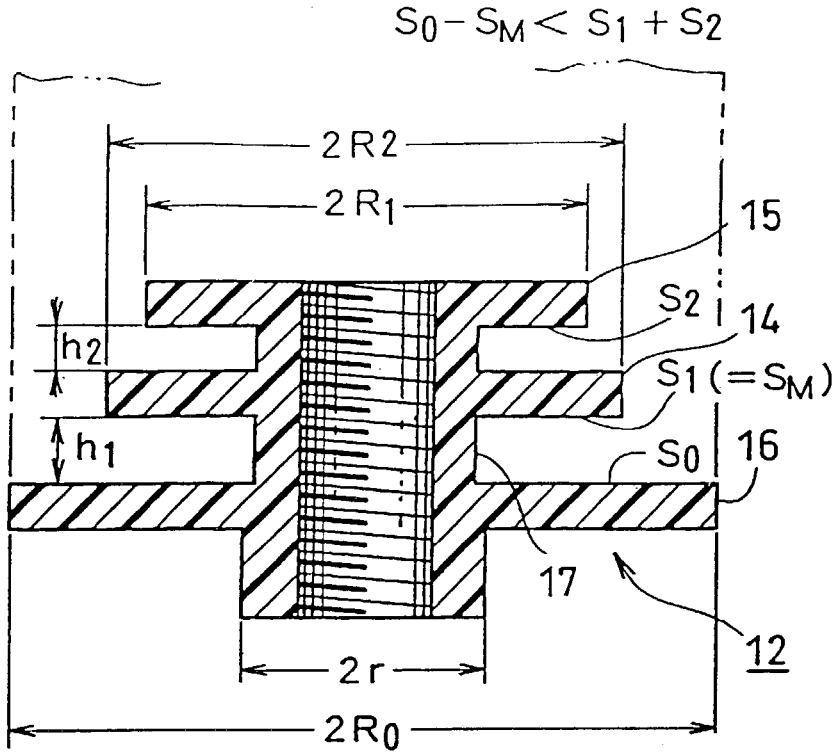
FIG. 4 is a longitudinal sectional view of another embodiment of a slider according to the invention.
Figure 5:
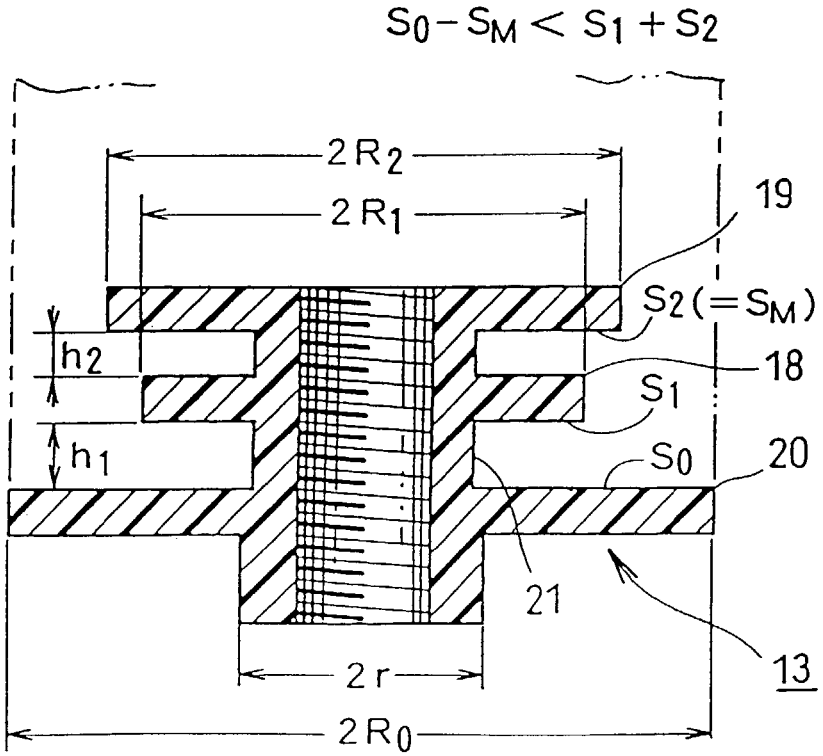
FIG. 5 is a longitudinal sectional view of still another embodiment of a slider according to the invention.

In order to prevent the paste 7 from being torn and falling off, it is generally preferable to form the protrusions 10 and 11 satisfying equation 1, as stated before. It is, however, possible that the paste 7 may not be torn and fall off even under conditions not satisfying equation 1, depending on the hardness of the paste 7. FIGS. 4 and 5 show different forms of sliders 12 and 13 embodying this invention, but not satisfying equation (1).

The slider 12 shown in FIG. 4 has two protrusions 14 and 15 extending from its cylindrical portion 17. The lower protrusion 14 has a lower surface area $S_1$ which is larger than the lower surface area $S_2$ of the upper protrusion 15, and they do not satisfy equation (1) in relation to the upper surface area $S_0$ of the base portion 16.

The slider 13 shown in FIG. 5 also has two protrusions 18 and 19 extending from its cylindrical portion 21, but the upper protrusion 19 has a lower surface area $S_2$ which is larger than the lower surface area $S_1$ of the lower protrusion 18, and they do not satisfy equation (1) in relation to the upper surface area $S_0$ of the base portion 20.

In order to prevent the paste 7 from falling off the casing 3 under conditions not satisfying equation 1 as shown in FIG. 4 or 5, or under conditions satisfying equation 3 below, it is possible to form the protrusions 14 and 15, or 18 and 19 so that they may satisfy equation 4 below:

$$S_0-S_M<S_1+S_2+\ldots+S_n \quad (3)$$

$$CbP(S_0-S_M)=Nb\geqq20 \quad (4)$$

where $S_0$ stands for the area ($cm^2$) of the upper surface of the base portion;

$S_1$ to $S_n$ each stand for the area ($cm^2$) of the lower surface of one of the number (n) of protrusions;

$S_M$ stands for the maximum area ($cm^2$) of $S_1$ to $S_n$;

each of $S_0$ and $S_1$ to $S_n$ excludes the area occupied by the cylindrical portion;

P stands for the hardness ($N/cm^2$) of the paste;

Cb is a constant;

Nb stands for the falling force (N) of the paste.

The constant Cb is usually $5.50\times10^5$, though it may somewhat depend on the frictional resistance existing between the inner wall surface of the casing 3 and the outer peripheral surface of the paste 7 like Ca as stated before.

Figure 6:
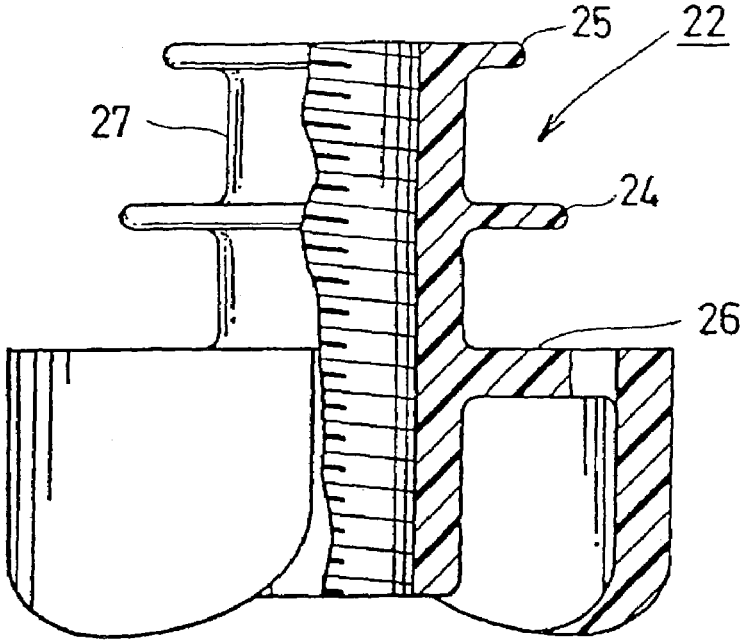
FIG. 6 is a longitudinal sectional view of still another embodiment of a slider according to the invention.
Figure 7:
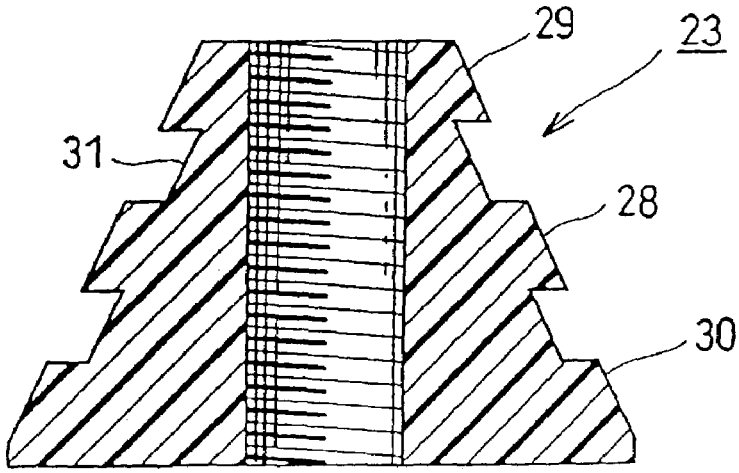
FIG. 7 is a longitudinal sectional view of still another embodiment of a slider according to the invention.
Figure 8:
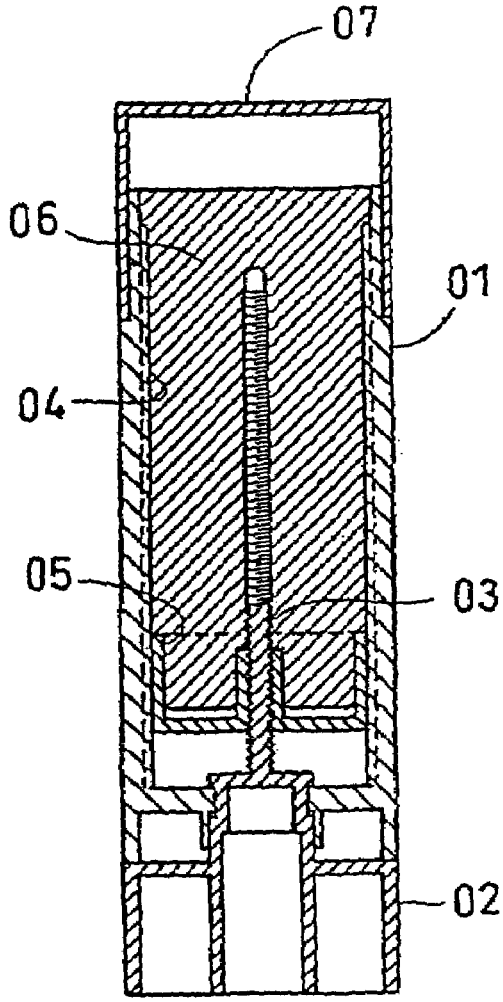
Fig. 8 PRIOR ART
FIG. 8 is a longitudinal sectional view of a conventional solid paste dispenser.

FIGS. 6 and 7 show still different forms of sliders 22 and 23 embodying this invention. The slider 22 shown in FIG. 6 has two circular protrusions 24 and 25 extending from its tubular portion 27 and having a smaller diameter as they are remoter from the base portion 26. The slider 23 shown in FIG. 7 likewise has two circular protrusions 28 and 29 extending from a tubular portion 31 and having a smaller diameter as they are remoter from the base portion 30, but its central portion 31 is not really cylindrical, but is substantially conical.

While equations (1) to (4) are excellently applicable to any slider having a central portion which is cylindrical, or uniform in diameter as shown at 9, 17, 21 or 27 in FIGS. 3, 4, 5 or 6, they are also applicable without presenting any practically important problem to any slider having a conical central portion as shown at 31 in FIG. 7.

Figure 9:
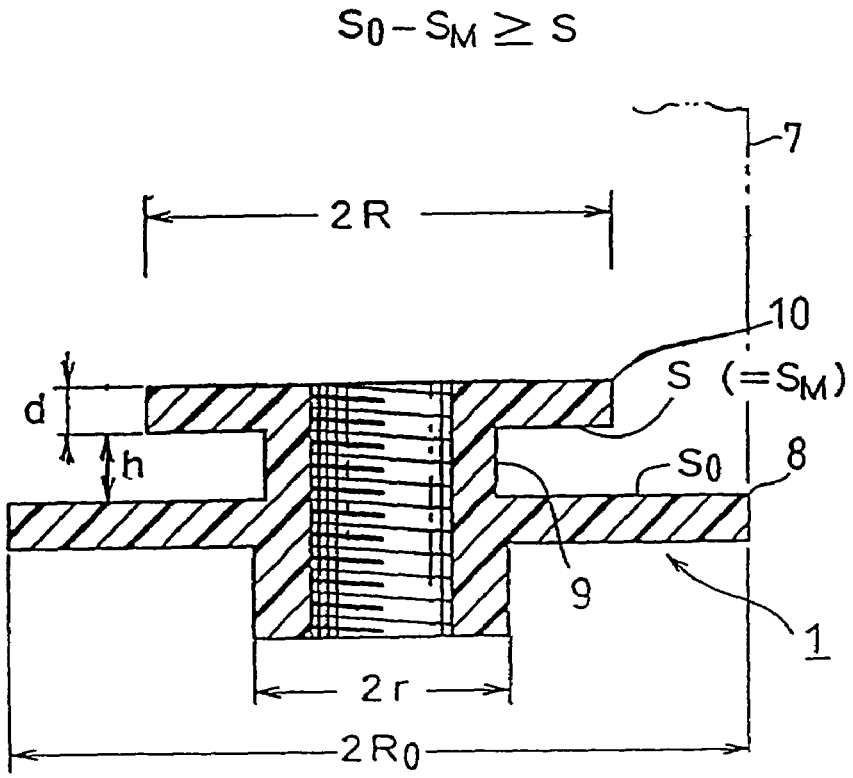
FIG. 9 a longitudinal sectional view of a slider according to another embodiment of the invention having a single protrusion.

FIG. 9 shows a slider similar to that shown in FIG. 3 but having a single protrusion 10 only. For further details reference can be made to the embodiment according to FIG. 3 and the description thereof.

The invention will now be described in further detail by way of a few specific examples and comparative examples.

EXAMPLE 1

Five sliders 1 of the type shown in FIG. 3 were prepared by designing circular protrusions 10 and 11 so that they satisfy equations (1) and (2) in which Na=21 N, when the following values were employed:

$$S_0=\pi R_0^2-\pi r^2,\ S_1=\pi R_1^2-\pi r^2,\ S_2=\pi R_2^2-\pi r^2,$$

$$S_1=S_2=S_M,\ Ca=11.06\times10^5,\ P=0.000055\ \mathrm{N/cm^2},$$

$$r=0.3\ \mathrm{cm},\ R_0=0.785\ cm,\ R_1=R_2=0.5\ \mathrm{cm},$$

$$S_0=\pi R_0^2-\pi r^2=1.65\ \mathrm{cm^2},\ S_1=S_2=\pi R_1^2-\pi r^2=0.5\ \mathrm{cm^2},$$

$$h_1=h_2=0.3\ \mathrm{cm},\ d_1=d_2=0.05\ \mathrm{cm}.$$

A solid paste 7 having a hardness P of 0.000055 $N/cm^2$ as mentioned above was attached to each slider 1 and a falling force of 20 N was applied to the paste 7 to cause it to fall off the slider 1. In no case whatsoever, the paste 7 was torn off, or fell off the slider 1.

Comparative Example 1

Five sliders 1 of the type shown in FIG. 3 were prepared by designing circular protrusions 10 and 11 so that they satisfy equation (1), but not satisfy equation (2) in which Na=16 N, when the following values were employed:

$$S_0=\pi R_0^2-\pi r^2,\ S_1=\pi R_1^2-\pi r^2,\ S_2=\pi R_2^2\pi r^2,$$

$$S_1=S_2=S_M,\ Ca=11.06\times10^5,\ P=0.000055\ \mathrm{N/cm^2},$$

$$r=0.3\ \mathrm{cm},\ R_{0=}0.785\ \mathrm{cm},\ R_1=R_2=0.43\ \mathrm{cm},$$

$$S_0=\pi R_0^2-\pi r^2=1.65\ cm^2,\ S_1=S_2=\pi R_1^2-\pi r^2=0.31\ \mathrm{cm^2},$$

$$h_1=h_2=0.3\ \mathrm{cm},\ d_1=d_2=0.05\ \mathrm{cm}.$$

A solid paste 7 having a hardness P of 0.000055 $N/cm^2$ as mentioned above was attached to each slider 1 and a falling force was applied to the paste 7 to cause it to fall off the slider 1. The falling force was gradually increased from 10 N and in every case upon application of a force of about 17 N on the average, the paste 7 was broken in its portions held between the protrusions 10 and 11 and between the base portion 8 and the protrusion 10, and fell off the slider 1.

EXAMPLE 2

Five sliders 12 of the type shown in FIG. 4 were prepared by designing circular protrusions 14 and 15 so that they satisfy equations (3) and (4) in which Nb=21 N, when the following values were employed:

$S_0=\pi R_0^2-\pi r^2$, $S_1=\pi R_1^2-\pi r^2$, $S_2=\pi R_2^2-\pi r^2$, $S_1=S_M$, $Cb=5.50\times10^5$, $P=0.000065$ N/cm$^2$, $r=0.3$ cm, $R_0=0.785$ cm, $R_1=0.63$ *cm*, $R_2=0.46$ cm, $S_0=\pi R_0^2-\pi r^2=1.65$ *cm*$^2$, $S_1=\pi R_1^2-\pi r^2=1.0$ *cm*$^2$, $S_2=\pi R_2^2-\pi r_2=0.4$ cm$^2$, $h_1=h_2=0.3$ cm.

A solid paste 7 having a hardness P of 0.000065 N/cm$^2$ as mentioned above was attached to each slider 12 and a falling force of 19 N was applied to the paste 7 to cause it to fall off the slider 12. In no case whatsoever, the paste 7 was torn off, or fell off the slider 12.

EXAMPLE 3

Five sliders 13 of the type shown in FIG. 5 were prepared by designing circular protrusions 18 and 19 so that they satisfy equations (3) and (4) in which Nb=21 N, when the following values were employed:

$S_0=\pi R_0^2\pi r^2$, $S_1=\pi R_1^2-\pi r^2$, $S_2=\pi R_2^2-\pi r^2$, $S_2=S_M$, $Cb=5.50\times10^5$, $P=0.000065$ N/cm$^2$, $r=0.3$ cm, $R_0=0.785$ cm, $R_1=0.46$ cm, $R_2=0.63$ cm, $S_0=\pi R_0^2-\pi r^2=1.65$ cm$^2$, $S_1=\pi R_1^2-\pi r^2=0.4$ cm$^2$, $S_2=\pi R_2^2-\pi r^2=1.0$ cm$^2$, $h_1=h_2=0.3$ cm.

A solid paste 7 having a hardness P of 0.000065 N/cm$^2$ as mentioned above was attached to each slider 13 and a falling force of 19 N was applied to the paste 7 to cause it to fall off the slider 13. In no case whatsoever, the paste 7 was torn off, or fell off the slider 13.

Comparative Example 2

Five sliders 12 of the type shown in FIG. 4 were prepared by designing circular protrusions 14 and 15 so that they satisfy equation (3), but not equation (4), when the following values were employed:

$S_0=\pi R_0^2-\pi r^2$, $S_1=\pi R_1^2-\pi r^2$, $S_2=\pi R_2^2-\pi r^2$, $S_1=S_M$, $Cb=5.50\times10^5$, $P=0.000065$ N/cm$^2$, $r=0.3$ cm, $R_0=0.785$ cm, $R_1=0.67$ cm, $R_2=0.43$ cm, $S_0=\pi R_0^2-\pi r^2=1.65$ cm$^2$, $S_1=\pi R_1^2-\pi r^2=1.15$ cm$^2$, $S_2=\pi R_2^2-\pi r^2 0.29$ cm$^2$, $h_1=h_2=0.3$ cm.

A solid paste 7 having a hardness P of 0.000065 N/cm$^2$ as mentioned above was attached to each slider 12 and a falling force was applied to the paste 7 to cause it to fall off the slider 12. The falling force was gradually increased from 10 N and in every case upon application of a force of about 18 N on the average, the paste 7 was broken in its portions held between the protrusions 14 and 15 and between the base portion 12 and the protrusion 14, and fell off the slider 12.

The above description of embodiments of the invention has been given by way of example. From the disclosure given, those skilled in the art will not only understand the present invention and the attendant advantages, but will also find apparent various changes and modifications to the structures disclosed. It is sought, therefore, to cover all such changes and modifications as within the spirit and scope of the invention, as defined by the appended claims, and equivalents thereof.

What is claimed is:

1. A slider for holding a stick of a solid paste for use in a solid paste dispenser, said solid paste dispenser comprising a cylindrical casing and a screw rod for engaging in threaded manner with said slider and forming an integral part of a tail plug fitted in one end of the casing for rotating the screw rod and for moving the slider so that the paste may be protruded out of the casing at the distal end thereof or retracted thereinto, said slider including a planar base portion and a tubular portion projecting from a center of the base portion into the paste, said screw rod being adapted to extend through the base and tubular portions for engaging therewith in threaded manner, the tubular portion having as an integral part thereof a radially outwardly extending protrusion which is formed so as to satisfy the following equation (1):

$$S_0-S_M\geqq S \quad (1)$$

where $S_0$ stands for the area (cm$^2$) of the upper surface of the base portion;

S stands for the area (cm$^2$) of the lower surface of said protrusion;

$S_M$ stands for a maximum area (cm$^2$) of S;

each of $S_0$ and S excludes the area occupied by the tubular portion;

wherein said protrusion is formed so as to further satisfy the following equation (2):

$$CaP(S\ h)/\{(h+d)\}=Na\geqq20 \quad (2)$$

where h stands for the distance (cm) between the base portion and the protrusion;

d stands for the thickness (cm) of the protrusion;

P stands for the hardness (N/cm$^2$) of the paste;

Ca is a constant;

Na stands for the falling force (N) of the paste.

2. The slider according to claim 1, wherein Ca=11.06×10$^5$.

3. The slider according to claim 1, wherein the thickness of the protrusion is less than one-fifth of the distance between the protrusion and the base portion.

4. The slider according to claim 3, wherein Ca=9.49×10$^5$.

5. A slider for holding a stick of a solid paste for use in a solid paste dispenser, said solid paste dispenser comprising a cylindrical casing and a screw rod for engaging in threaded manner with said slider and forming an integral part of a tail plug fitted in one end of the casing for rotating the screw rod and for moving the slider so that the paste may be protruded out of the casing at the distal end thereof or retracted thereinto, said slider including a planar base portion and a tubular portion projecting from a center of the base portion into the paste, said screw rod being adapted to extend through the base and tubular portions for engaging therewith in threaded manner, the tubular portion having as an integral part thereof a number of radially outwardly extending protrusions which are so formed as to satisfy the following equation (1):

$$S_0-S_M\geqq S_1+S_2+\ldots+S_n \quad (1)$$

where $S_0$ stands for the area ($cm^2$) of the upper surface of the base portion;

$S_1$ to $S_n$ each stand for the area ($cm^2$) of the lower surface of one of the number (n) of protrusions;

$S_M$ stands for a maximum area ($cm^2$) of $S_1$ to $S_n$;

each of $S_0$ and $S_1$ to $S_n$ excludes the area occupied by the tubular portion.

6. The slider according to claim 5, wherein the protrusions have the same shape.

7. The slider according to claim 5, wherein each protrusion is circular.

8. The slider according to claim 5, wherein each protrusion is polygonal.

9. The slider according to claim 5, wherein the lower surfaces of all protrusions have the same area ($S_1$ to $S_n$ are equal).

10. The slider according to claim 5, wherein all protrusions lie one above another along the tubular portion, each protrusion having a radial dimension, the radial dimensions becoming smaller as the protrusion is more remote from the base portion.

11. The slider according to claim 5, wherein the protrusions are so formed as to further satisfy the following equation (2):

$$CaP(S_1h_1+S_2h_2+\ldots+S_nh_n)/\{(h_1+h_2+\ldots+h_n)+(d_1+d_2+\ldots+d_n)\}=Na>20 \quad (2),$$

where $h_1$ to $h_n$ each stands for the distance (cm) between the base portion and the protrusion facing it and adjacent protrusions, $d_1$ to $d_n$ each stands for the thickness (cm) of each protrusion, P stands for the hardness ($N/cm^3$) of the paste, Ca is a constant;

Na stands for the falling force (N) of the paste.

12. The slider according to claim 11, wherein $Ca=11.06\times10^5$.

13. The slider according to claim 11, wherein the thickness of the protrusions is less than about one-fifth of the distance between adjoining protrusions.

14. The slider according to claim 13, wherein $Ca=9.49\times10^5$.

15. A slider for holding a stick of a solid paste for use in a solid paste dispenser, said solid paste dispenser comprising a cylindrical casing and a screw rod for engaging in threaded manner with said slider and forming an integral part of a tail plug fitted in one end of the casing for rotating the screw rod and for moving the slider so that the paste may be protruded out of the casing at the distal end thereof or retracted thereinto, said slider including a planar base portion and a tubular portion projecting from a center of the base portion into the paste, said screw rod being adapted to extend through the base and tubular portions for engaging therewith in threaded manner, the tubular portion having as an integral part thereof a radially outwardly extending protrusion which is so formed as to satisfy the following equations (3) and (4):

$$S_0-S_M<S \quad (3)$$

$$CbP(S_0-S_M)=Nb>20 \quad (4)$$

where $S_0$ stands for the area ($cm^2$) of the upper surface of the base portion;

S stands for the area ($cm^2$) of the lower surface of the protrusion;

$S_M$ stands for a maximum area ($cm^2$) of S;

each of $S_0$ and S excludes the area occupied by the tubular portion;

P stands for the hardness ($N/cm^2$) of the paste;

Cb is a constant;

Nb stands for the falling force (N) of the paste.

16. The slider according to claim 15, wherein the protrusion is circular.

17. The slider according to claim 15, wherein the protrusion is polygonal.

18. The slider according to claim 15, wherein $Cb=5.50\times10^5$.

19. A slider for holding a stick of a solid paste for use in a solid paste dispenser, said solid paste dispenser comprising a cylindrical casing and a screw rod for engaging in threaded manner with said slider and forming an integral part of a tail plug fitted in one end of the casing for rotating the screw rod and for moving the slider so that the paste may be protruded out of the casing at the distal end thereof or retracted thereinto, said slider including a planar base portion and a tubular portion projecting from a center of the base portion into the paste, said screw rod being adapted to extend through the base and tubular portions for engaging therewith in threaded manner, the tubular portion having as an integral part thereof a number of radially outwardly extending protrusions which are so formed as to satisfy the following equations (3) and (4):

$$S_0-S_M<S_1+S_2+\ldots+S_n \quad (3)$$

$$CbP(S_0-S_M)=Nb\geqq20 \quad (4)$$

where $S_0$ stands for the area ($cm^2$) of the upper surface of the base portion;

$S_1$ to $S_n$ each stands for the area ($cm^2$) of the lower surface of one of the number (n) of protrusions;

$S_M$ stands for a maximum area ($cm^2$) of $S_1$ to $S_n$;

each of $S_0$ and $S_1$ to $S_n$ excludes the area occupied by the tubular portion;

P stands for the hardness ($N/cm^2$) of the paste;

Cb is a constant;

Nb stands for the falling force (N) of the paste.

20. The slider according to claim 19, wherein the protrusions have a same shape.

21. The slider according to claim 19, wherein each protrusion is circular.

22. The slider according to claim 19, wherein each protrusion is polygonal.

23. The slider according to claim 19, wherein the lower surfaces of all protrusions have a same area ($S_1$ to $S_n$ are equal).

24. The slider according to claim 19, wherein all protrusions lie one above another along the tubular portion, each protrusion having a radial dimension, the radial dimensions becoming smaller as the protrusion is more remote from the base portion.

25. The slider according to claim 19, wherein all protrusions lie one above another along the tubular portion each protrusion having a radial dimension, the radial dimensions becoming larger as the protrusion is more remote from the base portion.

26. The slider according to claim 19, wherein $Cb=5.50\times10^5$.

27. The slider according to claim 1, wherein the protrusion is circular.

28. The slider according to claim 1, wherein the protrusion is polygonal.

* * * * *